US006192913B1

(12) United States Patent
Willey et al.

(10) Patent No.: US 6,192,913 B1
(45) Date of Patent: Feb. 27, 2001

(54) GAS VALVE FOR PILOTLESS GAS BURNER

(75) Inventors: John R. Willey; Eric M. Kaltenmark; Ricky J. Fielder, all of Bowling Green, KY (US)

(73) Assignee: DESA International, Bowling Green, KY (US)

( * ) Notice: Subject to any disclaimer, the term of this patent is extended or adjusted under 35 U.S.C. 154(b) by 0 days.

(21) Appl. No.: 09/116,517

(22) Filed: Jul. 16, 1998

(51) Int. Cl.[7] ..... F23D 14/72; F23N 5/10; F23Q 9/08

(52) U.S. Cl. ..... 137/66; 251/207; 431/255

(58) Field of Search ..... 137/65, 66; 251/207; 431/72, 75, 77, 254, 255

(56) References Cited

U.S. PATENT DOCUMENTS

| | | | | |
|---|---|---|---|---|
| 1,229,038 | * | 6/1917 | Cornelius | 251/207 |
| 2,734,563 | | 2/1956 | Newell | 158/129 |
| 2,735,439 | * | 2/1956 | Coffey | 137/66 |
| 2,886,050 | | 5/1959 | Lamar | 137/66 |
| 3,002,519 | * | 10/1961 | Wright et al. | 137/66 |
| 3,236,252 | * | 2/1966 | Allingham | 137/66 |
| 3,344,835 | * | 10/1967 | Hodgson | 431/255 |
| 3,348,561 | * | 10/1967 | MacLennan | 137/66 |
| 3,508,850 | * | 4/1970 | Good | 431/255 |
| 3,582,249 | | 6/1971 | Hodgson | 431/74 |
| 3,676,047 | * | 7/1972 | Soma | 137/66 |
| 3,768,959 | * | 10/1973 | Rohde et al. | 431/255 |
| 3,804,106 | * | 4/1974 | Buezis et al. | 137/66 |
| 3,813,207 | * | 5/1974 | Ramey | 431/255 |
| 4,207,054 | | 6/1980 | Sobole | 431/69 |
| 4,242,078 | * | 12/1980 | Nelson et al. | 431/45 |
| 4,242,080 | | 12/1980 | Tabei | 431/54 |
| 4,243,373 | | 1/1981 | Fernstrom et al. | 431/66 |
| 4,289,476 | | 9/1981 | Visos et al. | 431/66 |
| 4,691,136 | * | 9/1987 | Schmidt | 310/339 |
| 4,870,314 | * | 9/1989 | Hefling | 310/339 |
| 5,094,259 | * | 3/1992 | Hsu | 137/66 |
| 5,211,157 | * | 5/1993 | Schwartz et al. | 126/39 E |
| 5,240,406 | * | 8/1993 | Kanesaka | 431/66 |
| 5,295,818 | | 3/1994 | Robinson | 431/75 |
| 5,375,585 | | 12/1994 | Home | 126/39 E |
| 5,636,978 | * | 6/1997 | Sasaki | 431/69 |

FOREIGN PATENT DOCUMENTS

| | | | | |
|---|---|---|---|---|
| 1948075 | * | 7/1970 | (DE) | 251/207 |

* cited by examiner

*Primary Examiner*—George L. Walton
(74) *Attorney, Agent, or Firm*—Jones, Day, Reavis & Pogue

(57) ABSTRACT

A control valve assembly for a pilotless gas burner in which the valve has a gas inlet port and a single gas outlet port. Interposed between the gas inlet port and the single gas outlet port is a sleeve that provides predetermined amounts of gas flow to the single gas output port depending upon a plurality of orifices in the sleeve being opened or closed. The valve automatically closes if the main burner flame is extinguished and must be restarted manually. Further, manual control of the valve is provided by a shaft which is rotatably and axially inserted into the valve to provide ignition fuel to the burner and to regulate the amount of fuel flow through the sleeve to the single output port and the burner.

16 Claims, 3 Drawing Sheets

GAS VALVE FOR PILOTLESS GAS BURNER

BACKGROUND OF THE INVENTION

1. Field of the Invention

The present invention relates in general to gas valves for gas burners and in particular to an improved gas valve for a pilotless gas burner.

2. Description of Related Art Including Information Disclosed Under 37 CFR 1.97 and 1.98

There are many burner systems that use a pilot light adjacent the main burner to ignite the main burner. Such systems have shown to be unsafe because there may be a burner flame-out and an accumulation of gas which may cause an explosion.

Thus, pilotless burner systems have been developed. Such systems are shown in U.S. Pat. Nos. 3,344,835; 3,582,249; and 4,207,054. In these patents, there are no gas flow paths through the valve that will allow different amounts of gas to be fed to the burner for ignition, running at low temperatures, and running at high temperatures. Further, they have only emergency manual controls.

Typical designs of convection heaters provide gas flow into an automatic control valve that divides the gas flow into two independent circuits, the pilot burner and the main burner.

Following ignition of the pilot burner, a thermocouple responds to the presence of the flame and provides power to the automatic control valve. The power flowing into the automatic control valve allows the valve to remain open and gas to flow into the main burner. Downstream from the automatic control valve in the main burner gas circuit is a manual control valve used to control the amount of fuel to the main burner. The operator adjusts the manual control valve to provide the desired amount of heat.

There are a number of concerns with this type of arrangement. First, proper operator involvement with the multiple valve system is very important. Failure to follow operating instructions could result in accidental starting of the main burner, delayed ignition of the main burner, and operation beyond the specified range.

Accidental ignition of the main burner occurs if the pilot burner flame proves the thermocouple and the manual control valve is not in the OFF position. Delayed ignition of the main burner can occur due to improper operation of the manual control valve. Failure to open the manual control valve to the full open position during ignition may cause delayed ignition. The operator can partially close the manual control valve, which reduces main burner gas flow below a specified input rate. Operation at reduced input rate can create high carbon monoxide, odor, and/or soot from incomplete combustion.

Further, flame supervision for the pilot burner causes additional concerns such as nuisance pilot burner outage and unsupervised operation of the main burner. Heaters may be subjected to nuisance outage due to drafts extinguishing the pilot burner. Pilot burner outage deprives the thermocouple of heat necessary to produce electrical power. The loss of electrical power causes the automatic control valve to interrupt the gas flow to all burners. In addition, the unsupervised main burner may operate below minimum input rate until the heater is manually shut down. In some cases, the main burner flame could become extinguished but still the system could flow gas because the thermocouple is supervising the pilot burner.

It would be advantageous to have a single automatic control valve system wherein the automatic safety control and the manual adjustment of the main control valve are contained within one control thus reducing the number of components.

SUMMARY OF THE INVENTION

The present invention provides a single automatic control valve system wherein the automatic control of the valve and manual adjustment of the valve are provided within one control body thus reducing the number of components in the system. In order to start the heater, the operator need only to rotate a control knob to an indicated "low" position and depress. After ignition of the burner system with piezoignition, the control knob is released and the thermocouple holds the valve open. In order to change the heat output of the heater from the low position, the operator need only to rotate the control knob to the desired heat setting. Unlike variable valves used on other heaters, the variable automatic control valve of the present invention has defined low, medium, and high positions. Previous designs were subject to the operator's interpretation of operating instructions. Unlike manual valves used on other heaters, the variable automatic control valve has limited operating positions and prohibit operation beyond a specified range. With this valve, there is pilotless ignition and the main burner is directly ignited, not indirectly with a pilot flame. Since the main burner is ignited, it is monitored directly with the thermocouple. Thus, the present valve includes fewer parts to assemble and maintain.

It is, therefore, an object of the present invention to provide a gas burner control valve for a pilotless ignition system in which the valve has a gas inlet valve and a single gas outlet valve to the gas burner with a manual gas flow control mechanism within the body or housing.

It is another object of the present invention to provide a gas control valve that has a gas metering sleeve between the gas input port and the single gas output port for controlling the amount of gas being coupled between the gas input port and the gas output port.

It is still another object of the present invention to provide a manual control for the valve for ignition and control of the amount of the gas flowing to the burner.

It is also an object of the present invention to provide both automatic shutdown of the valve and manual control of the valve in the same housing.

Thus, the present invention relates to a gas valve for a pilotless gas burner system comprising a valve body, a gas input port in the valve body, a single gas output port in the valve body for providing gas to the gas burner, a hollow gas metering sleeve having a wall and a gas input orifice, the sleeve being positioned between the gas input port and the single gas output port. A first ignition orifice is formed in the sleeve wall for providing sufficient gas to the single gas output port to ignite the gas burner. A second "run" orifice in the sleeve wall adds sufficient gas to that provided by the first orifice to enable the gas burner to provide a first minimum heat. At least a third orifice in the sleeve adds gas to that provided by the first and second orifices to increase the heat output of the burner system. A manually operated control shaft is associated with the sleeve for selectively coupling the first, second, and third sleeve orifices to the single gas output port. A thermocouple controlled solenoid holds the valve open as long as the gas burner is lit but automatically shuts off the gas flow when the burner is not lit.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which.

DETAILED DESCRIPTION OF THE PREFERRED EMBODIMENT(S)

Figure 1:
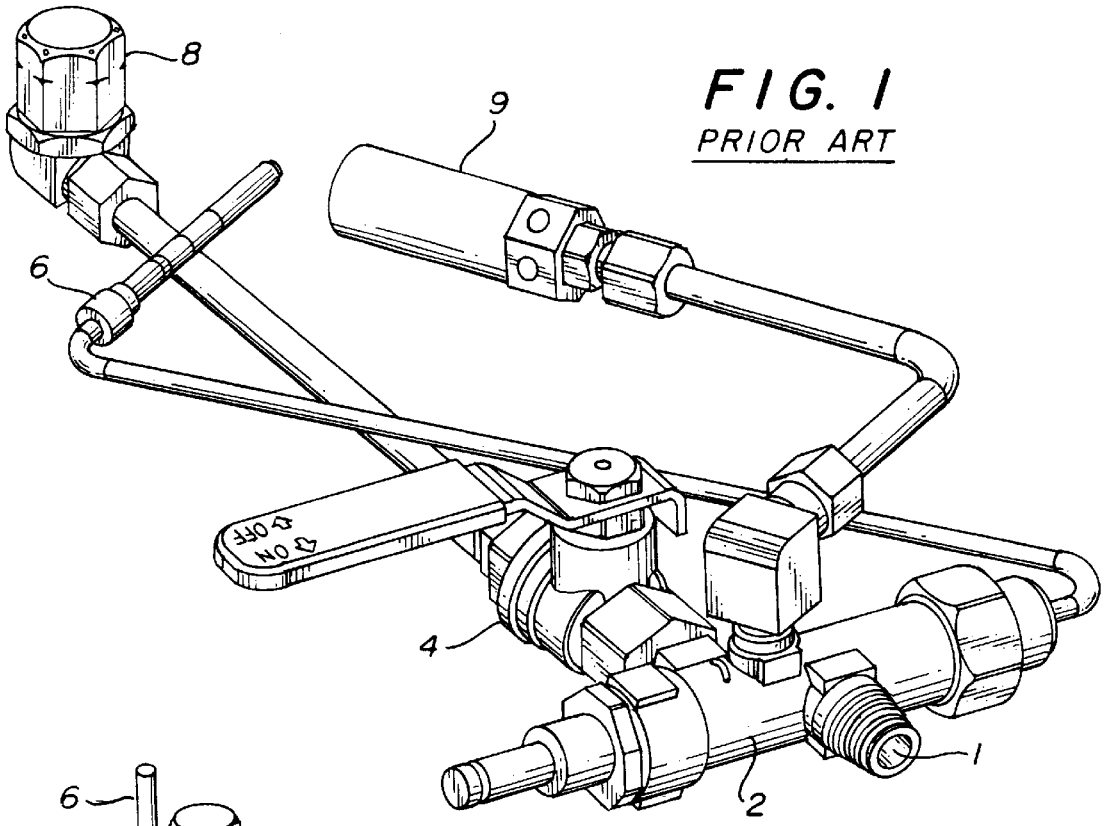
FIG. 1 PRIOR ART
FIG. 1 is a schematic view of a pilot controlled burner system of the prior art.

FIG. 1 discloses the pilot control of the burner system of the prior art. Gas flow is coupled through a gas input port 1 in the automatic control valve 2. The automatic control valve 2 divides the gas flow into two independent circuits, the pilot burner 9 and the main burner 8. Following ignition of the pilot burner 9, the thermocouple 6 responds to the presence of the flame and provides power to the automatic control valve 2. The power flowing into the automatic control valve 2 allows the valve to remain open and the gas to flow into the main burner 8. Downstream from the automatic control valve 2 in the main burner gas circuit is a manual control valve 4 used to control the amount of fuel to the main burner 8. The operator adjusts the manual control valve 4 to provide the desired amount of heat.

As stated earlier, there are several concerns with this system. Accidental ignition of the main burner 8 occurs if the flame of the pilot burner 9 proves the thermocouple 6 and the manual control valve 4 is not in the OFF position. Further, a delayed ignition of the main burner 8 can occur due to improper operation of the manual control valve 4. The failure to open the manual control valve 4 to the full open position during ignition may cause delayed ignition. Further, the operator can partially close the manual control valve 4 which reduces main burner gas flow below a specified input rate. Operation at reduced input rate can create high carbon monoxide, odor, and/or soot from incomplete combustion.

Flame supervision of the pilot burner 9 causes additional concerns. Thus, heaters may be subjected to nuisance outage due to air drafts extinguishing the pilot 9. Pilot burner outage deprives the thermocouple 6 of heat necessary to produce electrical power. The loss of electrical power causes the automatic control valve 2 to interrupt the gas flow to all burners. Also, the unsupervised main burner 8 may operate below a minimum input rate until the heater is manually shut down. In some cases, the flame of the main burner 8 can become extinguished but still be flowing gas because the thermocouple 6 is supervising the pilot burner 9.

Figure 2:
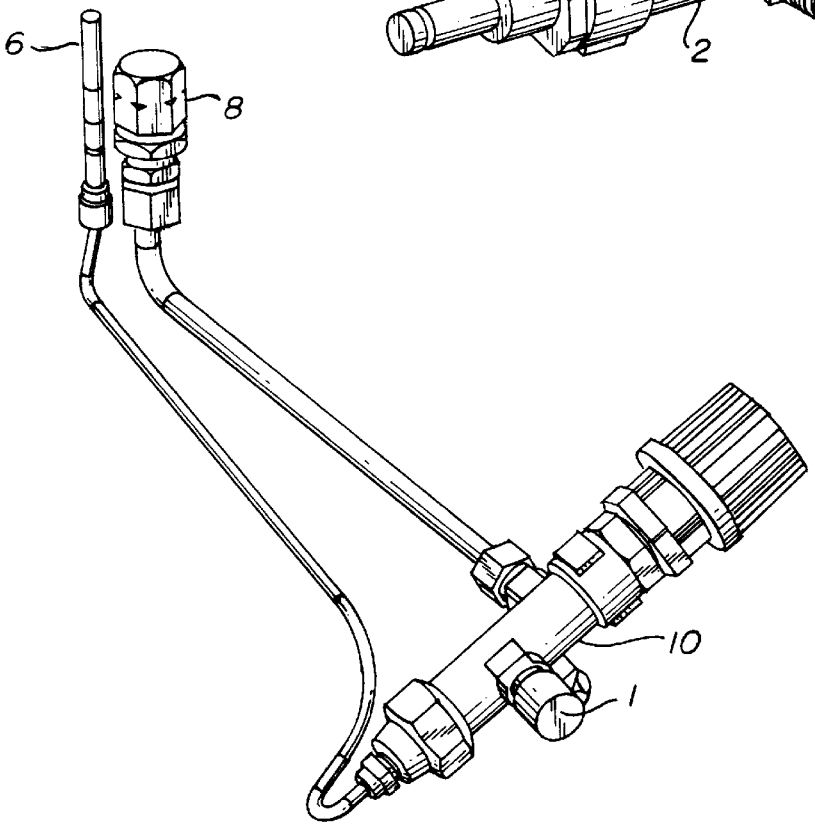
FIG. 2 is a schematic representation of the pilotless burner system of the present invention controlled by an automatic control valve.

FIG. 2 is a diagrammatic representation of the pilotless burner system of the present invention wherein like numerals are used for like components in FIG. 1. In this system, there is only one gas input port and a single gas output port in automatic control valve 10. The single gas output port is coupled to the main burner 8. A thermocouple 6 monitors the main burner 8 and provides an electrical signal to a solenoid in the automatic control valve 10 to hold the valve open when the main burner 8 is lit and to close the automatic control valve 10 when the main burner flame is extinguished.

Figure 3:
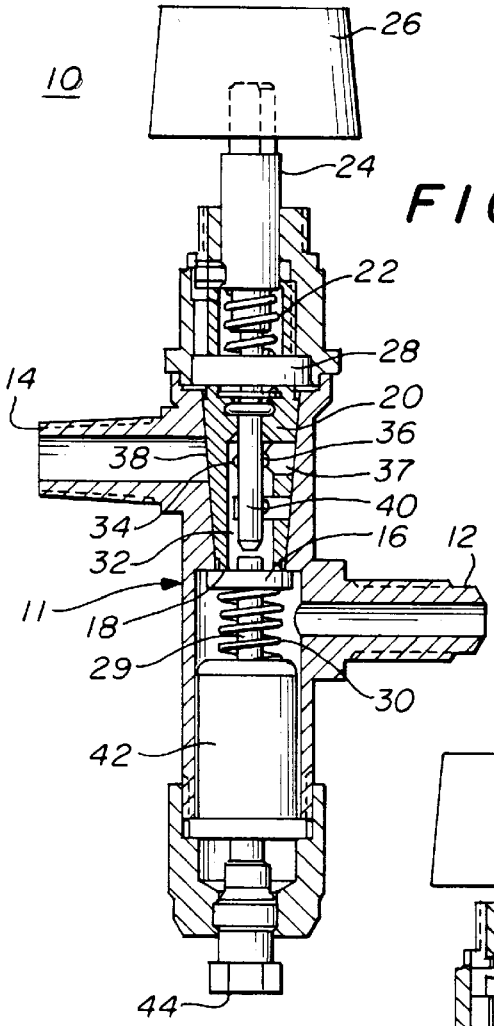
FIG. 3 is a partial cross-sectional view of a first embodiment of the control valve illustrating the internal components for controlling gas flow and illustrating the valve in its closed position.

FIG. 3 is a partial cross-sectional view of a first embodiment of the automatic control valve 10 of the present invention. FIG. 3 illustrates the valve in its closed position. The valve 10 has a valve body 11, a gas input port 12 in the valve body and a single gas output port 14 in the valve body for providing gas to the gas burner 8 shown in FIG. 2. A hollow gas metering sleeve 20 has a wall 38 and a gas input orifice 18. The sleeve is positioned between the gas input port 12 and the single gas output port 14. A first ignition orifice 34 in the sleeve wall 38 provides sufficient gas to the single gas output port 14 to ignite the gas burner. A second "run" orifice 36 in the sleeve wall 38 adds sufficient gas to that provided by the first orifice 34 to enable the gas burner to provide a first minimum heat. At least a third orifice 37 is provided in the sleeve wall 38 for adding gas to that provided by the first and second orifices 34, 36 to increase the heat output of the burner system. A manually operated control means 24 in the form of a shaft is associated with the sleeve 20 for selectively coupling the first, second, and third sleeve orifices (34, 36, 37) to the single gas output port 14.

The gas metering sleeve 20 has a gas inlet orifice 18 and there is a seal 16 for closing and opening the gas inlet orifice 18 to the sleeve 20. The thermocouple 6 shown in FIG. 2 associated with the gas burner 8 generates an electrical signal when the gas burner 8 is lit. A solenoid 42 in the valve housing 11 has a plunger 29 coupled to the seal 16. The thermocouple supplies the electrical signal to the solenoid 42 to keep the plunger 29 and the seal 16 off the sleeve gas inlet orifice 18 and supply gas to the gas burner 8 when the gas burner 8 is lit. It will be noted that the gas metering sleeve 20 is rotatable and has a gas chamber 32 therein. Shaft 24, the manually operated control device, is rotatably coupled to the sleeve 20 in any well-known manner such as by splines or flat surfaces in bonnet 28 that is attached to the sleeve 20. Thus, the shaft 24 can slide through the gas metering sleeve axially but also can rotate the sleeve 20. The first 34, second 36, and at least third orifice 37 are circumferentially spaced about the sleeve wall 38 in gas flow contact with the gas chamber 32 such that, when the manually operated shaft 24 is rotated, the sleeve 20 rotates to align a desired one of the orifices 34, 36, 37 with the gas outlet port 14 for gas flow.

The seal 16 is normally urged against and closes the gas inlet orifice 18 by spring 30. Thus it prevents gas flow from the inlet port 12 to the gas chamber 32 in the gas metering sleeve 20. The shaft 24 is axially slidable through sleeve 20. It can be used to manually move the seal 16 to open the gas inlet orifice 18 to receive gas flow into the gas chamber 32. As stated earlier, the shaft 24 can be manually rotated to position the sleeve 20 and selectively couple gas flow from one of the first, second, and at least third orifices 34, 36, 37 to the single output port 14 to supply the proper flow of gas to the burner.

The operation of the valve 10 is as follows. When in the OFF position, as shown in FIG. 3, fuel flow entering the burner system through the supply port 12 is blocked by the de-energized solenoid 42 and seal 16. The spring assembly 22 maintains an outward force on the control shaft 24 at all times. The control shaft 24 rests at any position from "low" through "high" and is controlled by the orientation of the control knob 26 in the well-known coupling in bonnet 28. Thus the control knob orientation rotationally determines the control shaft circular rotation and therefore controls which orifice 34, 36, 37 through which the fuel flows in metering sleeve 20 when in operation. Clearly, there could be more than the three orifices 34, 36, and 37 shown but, as shown, they could be used for "low", "medium", and "high" operation where "low" means the lowest heat, "medium" means a medium heat, and "high" means the highest heat.

Figure 5:
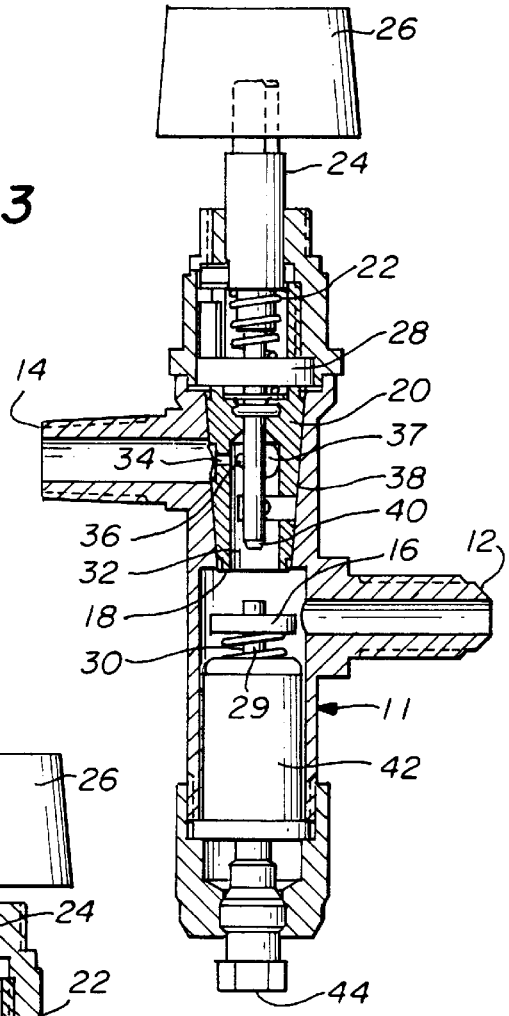
FIG. 5 is the same valve as in FIGS. 3 and 4 illustrating the valve in the position to provide varying amounts of gas to the burner during all operating conditions.
Figure 4:
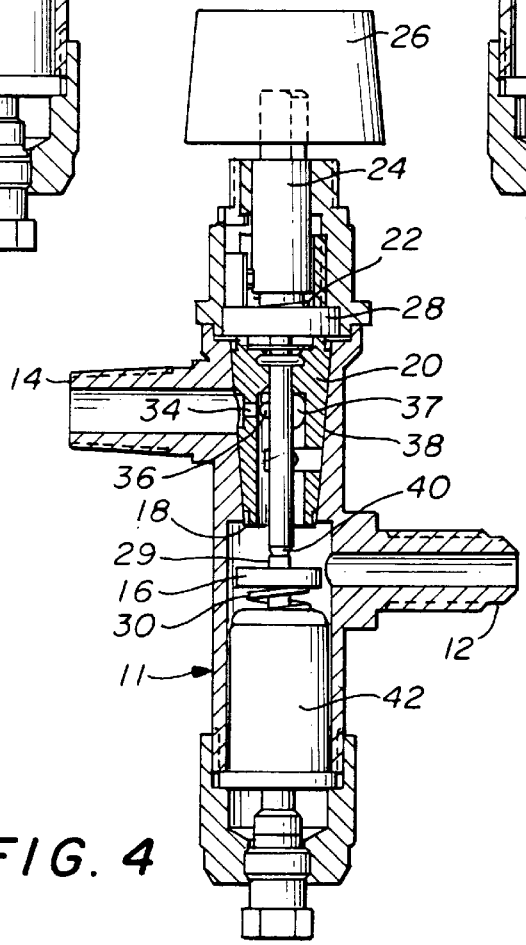
FIG. 4 is a partial cross-sectional view similar to FIG. 3 except that the valve is shown in the position to provide gas for ignition.

The ignition circuit fuel flow is shown in FIG. 4 and is activated by rotating the control knob 26 (and the metering sleeve 20) to the "low" position. At that time the control knob 26 is fully depressed which, in turn, depresses control shaft 24 that contacts solenoid shaft 29 on which seal 16 is attached and thus forces seal 16 away from gas inlet orifice 18 to allow gas to flow from the input port 12 into the inner chamber 32 of sleeve 20. The fuel flow from the inner chamber 32 of sleeve 20 to the single gas outlet port 14 is kept to the ignition level as determined by the ignition/low flow orifice 34 in the wall 38 of sleeve 20. Fuel flow higher than necessary for ignition is not allowed to flow through the valve due to the ignition/low flow orifice 34 diameter. While the control shaft 24 is depressed, gas flows to the burner 8 and the fuel is ignited at the burner 8 by means of a well-known ignition source, not shown, such as a piezoelectric ignitor. When the burner 8 is ignited, the thermocouple 6 in FIG. 2 is warmed by the flame during the ignition stage thus creating the electrical power to solenoid 42 through coupling 44 that energizes the solenoid and holds the plunger 29 with seal 16 away from the gas inlet orifice 18 of the metering sleeve 20. Since the seal 16 has now opened gas inlet orifice 18 and holds it open, the control knob 26 may be released allowing the control shaft 24 to be moved to the low position. Thus as shown in FIG. 5, the "run" position, the solenoid 42 is keeping the valve open to allow gas to flow from the inlet port 12 through flow orifice 36 in the metering sleeve 20 and out the single gas outlet port 14 to the burner.

The fuel flow can be varied for predetermined "low", "medium", and "high" levels by depressing and rotating control knob 26 which, in turn, rotates the metering sleeve 20 to couple any of the "low", "medium", and "high" flow orifices 34, 36, and 37, respectively, to couple the fuel in the hollow chamber 32 to the single gas outlet port 14. Thus the variability of fuel flow from low to high is controlled by the diameter of the orifices 34, 36, and 37 in the metering sleeve 20 for each setting. Of course, any desired number of orifices may be used instead of just orifices 34, 36, and 37.

To discontinue the flame, the fuel supply must be stopped by depressing and rotating the knob to an OFF position. At this position there is no orifice in the metering sleeve 20 that is coupled to the single gas outlet port 14, thus stopping the fuel flow to the burner 8. Thus, even though the seal 16 is held open, no fuel is being supplied through the single gas outlet port 14 to the burner 8. As the remaining fuel in the system burns off, the weakening flame allows the thermocouple 8 to cool. The cooling of the thermocouple in turn removes the electrical signal from solenoid 42 allowing it to release plunger 29 and cause seal 16 to close the gas inlet orifice 18 of the metering sleeve 20 thereby stopping fuel flow through the valve. After seal 16 closes the gas inlet orifice 18 to the metering sleeve 20, no fuel will flow through the valve even if the knob is rotated to either of the "low", "medium", or "high" positions.

Figure 6:
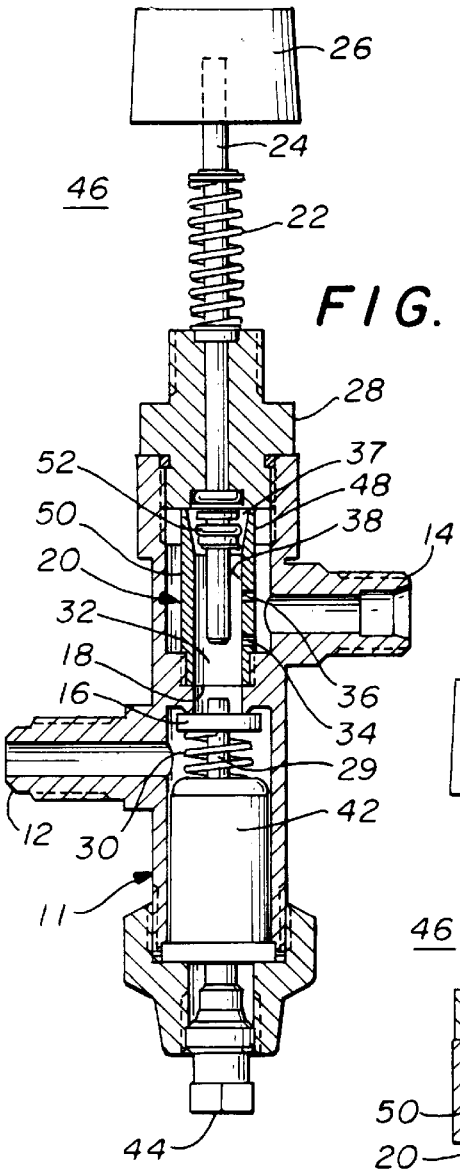
FIG. 6 is a partial cross-sectional view of a second embodiment of the novel gas valve of the present invention illustrating a gas metering sleeve that is controlled by axial extension of a manually controlled shaft and illustrates the valve in the OFF condition.
Figure 8:
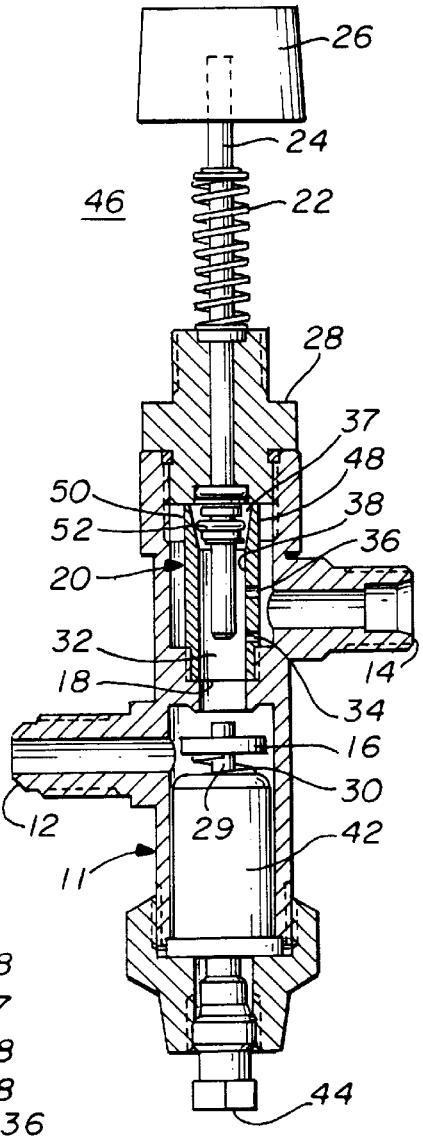
FIG. 8 is a partial cross-sectional view of the valve shown in FIGS. 6 and 7 illustrating the valve in its position for normal adjustable gas flow to the burner.
Figure 7:
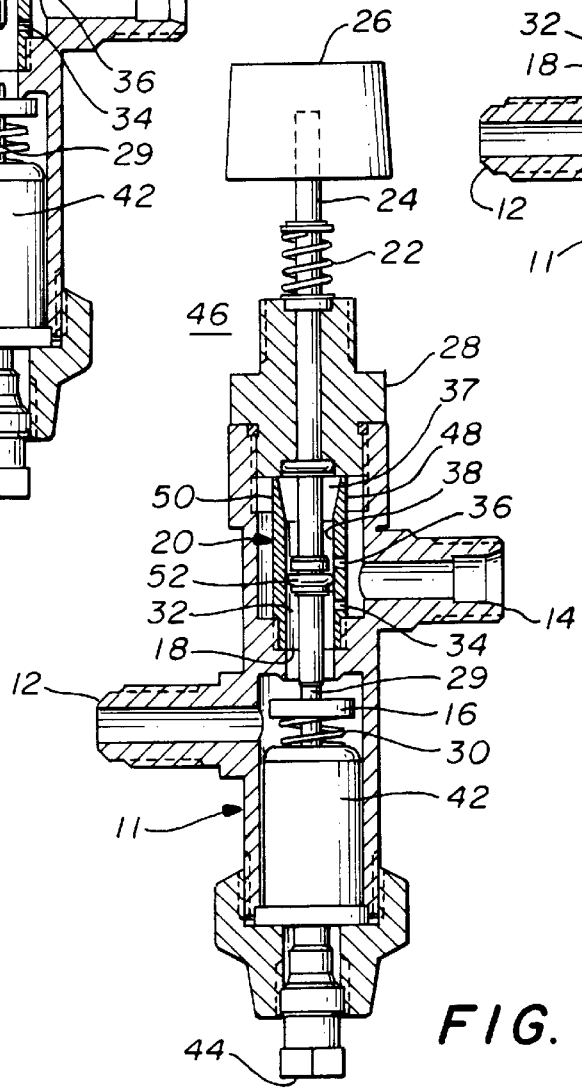
FIG. 7 is a partial cross-sectional view of the valve of FIG. 6 illustrating the valve in its state for providing ignition gas flow to the burner.

FIGS. 6, 7, and 8 disclose a second embodiment of a valve that can be used to control a pilotless gas burner. Like elements as in FIGS. 3, 4, and 5 have like numerals in FIGS. 6, 7, and 8. In FIG. 6, the gas valve 46 has a valve body 11, a gas input port 12, and a single gas outlet port 14 for providing gas to the gas burner.

Again, a hollow metering sleeve 20 has a wall 38 and a gas input port 12. The sleeve 20 is positioned between the gas input port 12 and the single gas outlet port 14. A first ignition orifice 34 is formed in the sleeve wall 38 for providing sufficient gas flow to the single gas outlet port 14 to ignite the gas burner. A second "run" orifice 36 in the sleeve wall 38 adds sufficient gas to that provided by the first orifice 34 to enable the gas burner 8 to provide a first minimum or "low" heat.

At least a third orifice 48 (in the form of a tapered orifice 37) forms an adjustable orifice for providing an adjustable gas flow output up to a maximum or "high" gas flow to the burner.

Thus, the first orifice 34 in the sleeve wall 38 provides a first gas flow sufficient for ignition and the second orifice 36 in the sleeve wall 38 provides a predetermined gas flow in addition to the gas flow from the first orifice 34 for a continuous run operation burning minimum gas or in the "low" operating range. The third adjustable orifice 48 in the sleeve 20 provides an adjustable gas flow output including a "medium" and a "high" or maximum gas flow to the burner.

A cylindrical bore 50 forms a portion of the sleeve 20 in axial alignment with the tapered orifice 37 and contains the first and second orifices 34 and 36. The shaft 24, attached to control knob 26, is axially coupled to the sleeve 20 as a manually operated control device. An O-ring assembly 52 is mounted on the shaft 24 for axial movement within the tapered orifice 37 and within the cylindrical bore 50 to control the first, second, and third orifices (34, 36, 37) when the shaft 24 is moved axially. A first axial position of the shaft 24 closes the second orifice 36 as shown in FIG. 7 and also blocks the tapered orifice 37 to allow only ignition gas to flow through the first orifice 34 to the single gas outlet valve 14. A second axial position of the shaft 24 opens the second orifice 36 by moving the O-ring to an axial location between orifice 36 and the tapered portion of sleeve 20 to provide sufficient gas flow for the continuous run operation in the minimum or "low" position. A third axial position places the O-ring assembly 52 within the tapered orifice 37. As will be understood, moving the O-ring assembly 52 axially within the tapered orifice 37 provides a predetermined amount of gas flow which is adjustable from a minimum up to a maximum gas flow to said burner. As the knob 26 rotates shaft 24, a well-known means for holding the shaft 24 in a predetermined axial position is provided and, although it is not shown, it is well known in the art. For instance, it could be a spiral-shaped surface on the valve body 11 with a pin on the valve stem 24 to follow the spiral shape and move the shaft 24 inwardly and outwardly through the sleeve 20.

The operation of the control valve shown in FIGS. 6, 7, and 8 is as follows. While resting in the OFF position shown in FIG. 6, fuel flow entering the burner system through supply port 12 is blocked by the de-energized solenoid 42 and seal 16. Again, the spring assembly 22 maintains an outward force on the control shaft 24 at all times. The control shaft 24 rests at any position of "low" through "high" controlled by the rotatable orientation of the control knob 26. The control knob orientation, as stated earlier, determines the control shaft axial location by well-known means, not shown, therefore controlling the amount of fuel flowing past the O-ring assembly 52 when in operation.

The valve as shown in FIG. 7 is shown in the position for ignition. It is operated by rotating the knob 26 and shaft 24 to the "low" position and fully depressing the control knob 26. The control shaft 24 is thereby depressed and manually contacts the shaft 29 of solenoid 42 removing seal 16 from blocking the gas inlet orifice 18 in sleeve 20. Thus, fuel is now allowed to flow from the supply port 12 through the gas inlet orifice 18 into the inner sleeve 20. The fuel flow to the single outlet port 14 is kept to the ignition level as determined by the diameter of the ignition port 34 in the wall 38 of sleeve 20. Fuel flow through orifices 36 and 38 is blocked by the O-ring assembly 52 mounted on the control shaft 24. While the control shaft 24 is depressed, allowing the ignition gas flow as shown in FIG. 7, the fuel is ignited at the burner 8 (shown in FIG. 2) by means of a well-known ignition source. The thermocouple 6 is warmed by flame at the ignition stage creating the electrical power necessary to energize solenoid 42 that holds the seal 16 away from the gas inlet orifice 18 allowing gas to flow into sleeve 20. The control knob 26 may now be released allowing the control shaft 24 to be moved to the "low" position. In this position, with the solenoid 42 energized, fuel will flow through both the ignition orifice 34 and the "low" range orifice 36 as shown in FIG. 8. This is the "low" RUN position. Thus, at this point the fuel flow consists of gas passing through the valve 11 by entering at the inlet port 12, passing seal 16 into interior of sleeve 20, and exiting to the burner 8 through the ignition orifice 34 and the "low" RUN orifice 36.

As shown in FIG. 8, the fuel flow can be increased variably from "low" to "high" levels by rotation of the control knob 24 which moves the control shaft 24 axially thereby moving the O-ring assembly 52 inwardly and outwardly in tapered orifice 37. Thus the variability of fuel flow from "low" to "high" is determined by the relative position of the O-ring assembly 52 within the tapered orifice 37 of the inner sleeve 20. Therefore, with the control shaft 24 at its highest position, the O-ring assembly 52 it is above the largest diameter of the cylindrical portion 50 of the sleeve 20. If the flame is extinguished, the thermocouple 6 cools. The cooling of the thermocouple 6 in turn causes solenoid 42 to release the plunger with seal 16 thereon and spring 30 forces the seal 16 against the fuel inlet orifice 18 as shown in FIG. 6, thus stopping any fuel flow through the valve to the single outlet port 14.

Thus, there has been disclosed a novel gas valve for a pilotless gas burner system that has automatic control through a solenoid that holds the valve in the open position so long as the burner flame is present and that automatically closes the valve to prevent any gas flow if the burner flame is extinguished.

The manual control of the valve consists of a sleeve within the valve interposed between the gas inlet port and the gas outlet port. A rotatable and axially movable shaft is used to either turn the valve to an ignition position, to a "low" position, a "medium" position, or a "high" position for operation of the gas burner and, in one embodiment, to an OFF position.

Thus, the present invention discloses a gas control valve that has a single output port, and that has a single shaft that can be rotated and/or depressed to manually control the amount of fuel, if any, that is being coupled to the burner and that automatically shuts "off" when the burner is not lit.

The corresponding structures, materials, acts, and equivalents of all means or step plus function elements in the claims below are intended to include any structure, material, or act for performing the function in combination with other claimed elements as specifically claimed.

We claim:

1. In a pilotless burner having a flame sensing device for generating an electrical signal indicating whether or not said burner is lit, a gas valve comprising:

a valve body having a gas input port and a single gas output port, said single gas output port coupled to said pilotless burner, such that said gas valve provides gas only to said pilotless burner;

adjustable regulating means within said valve body for manually adjusting the amount of gas coupled from said input port to said single output port, said adjustable regulating means including an ignition setting and at least one run setting; and automatic valve closing means in said valve body responsive to said electrical signal generated by said flame sensing device for stopping gas flow between said gas input port and said single gas output port when said burner is not lit and said adjustable regulating means is at said at least one run setting.

2. A gas valve for a pilotless gas burner system comprising:

a valve body, a gas input port in said valve body, a single gas output port in said valve body, said single gas output port for providing gas only to said gas burner;

a hollow gas metering sleeve having a wall, said sleeve being positioned between said gas input port and said single gas output port;

a first ignition orifice in said sleeve wall for providing sufficient gas to said single gas output port to ignite said gas burner;

a second "run" orifice in said sleeve wall for adding sufficient gas to that provided by said first orifice to enable said gas burner to provide a first minimum heat;

at least a third orifice in said sleeve wall for providing sufficient gas to increase the heat output of the burner system to a maximum; and manually operated control means associated with the sleeve for selectively coupling the first, second, and third sleeve orifices to said single gas output port.

3. The gas valve of claim 2 further comprising:

a gas inlet orifice in said gas metering sleeve;

a seal for closing and opening said gas inlet orifice to said sleeve;

a thermocouple associated with said gas burner for generating an electrical signal only when said gas burner is lit; and a solenoid in said valve housing having a plunger coupled to said seal, said thermocouple supplying said electrical signal to said solenoid to move said plunger and said seal to open said sleeve gas inlet orifice and automatically supply gas to said gas burner when said gas burner is lit.

4. The gas valve of claim 3 wherein:

said gas metering sleeve is rotatable and has a gas chamber therein;

said manually operated controlled means is a shaft rotatably coupled to said sleeve; and said first, second, and at least third orifices are spaced about said sleeve in gas filled contact with gas chamber such that, when said manually operated shaft is rotated, said sleeve rotates to fluid couple at least one of said orifices to said single said gas outlet port.

5. The gas valve of claim 4 further comprising:

a spring normally urging said seal against and closing said gas inlet orifice for preventing gas flow from said inlet port to said gas chamber in said gas metering sleeve;

said shaft being axially slidable through said sleeve to manually move said seal to open said gas inlet orifice to receive gas flow; and said shaft being manually rotatable to position said sleeve and selectively couple at least one of said first, second, and third orifices to said single gas output port to supply the proper flow of gas to said burner.

6. The gas valve of claim 3 further comprising:

a first orifice in said sleeve wall for providing a first gas flow sufficient for ignition;

a second orifice in said sleeve wall for providing a predetermined gas flow sufficient for continuous operation burning minimum gas; and a third adjustable orifice in said sleeve for providing an adjustable gas output up to a maximum gas flow to said burner.

7. The gas valve of claim 6 further comprising:

a tapered orifice on said sleeve forming said third adjustable orifice;

a cylindrical bore forming a portion of said sleeve in axial alignment with said tapered orifice and containing said first and second orifices;

a shaft slidably and rotatably coupled to said sleeve as said manually operated control means;

an O-ring assembly mounted on said shaft for axial movement within said tapered orifice and within said cylindrical bore to control said first, second, and third orifices when said shaft is moved axially;

said first axial position of said shaft closing said second orifice and said tapered orifice to allow only ignition gas to flow through said first orifice;

a second axial position of said shaft opening said second orifice to provide sufficient gas flow for said continuous "low" RUN operation burning minimum gas; and a third axial position adjustable within said tapered orifice to provide an adjustable gas flow output up to a maximum gas flow to said burner.

8. A gas valve assembly for a pilotless gas burner system comprising:

a valve body;

a gas inlet port in said valve body;

a single gas outlet port in said valve body, said single gas outlet port for providing gas only to said gas burner;

a gas metering sleeve in said valve body between said gas input orifice and said gas outlet orifice and having an inner chamber terminating in first and second ends with a wall and a gas inlet orifice on one end and gas metering outlets;

a movable seal normally biased against said gas inlet orifice of said gas metering sleeve to prevent any gas flow to said single gas output port; and manually operated control means for forcing said seal away from said gas inlet orifice of said gas metering sleeve and for controlling said gas metering outlets to allow a predetermined amount of gas flow through said single gas outlet port sufficient for ignition of said burner and to adjust the gas flow through said single output port after ignition of said burner.

9. The gas valve assembly of claim 8 further comprising:

a thermocouple associated with said gas burner for generating an electrical signal only when said gas burner is lit;

a solenoid in said valve body having a coil electrically connected to said thermocouple and a plunger connected to said seal; and said solenoid coil moving said plunger to cause said seal to open said gas inlet orifice of said gas metering sleeve when said gas burner is lit to automatically allow gas flow into said gas metering sleeve.

10. The gas valve assembly of claim 9 wherein said manually operated control means comprises:

a control shaft for slidably and rotatably extending into said valve body; and said control shaft having a length such that when it is forced inwardly into said valve body, the control shaft contacts said biased seal and forces said seal away from said gas inlet orifice of said fuel metering sleeve to allow gas flow into said sleeve inlet chamber.

11. The gas valve assembly of claim 10 further comprising coupling means for associating said control shaft with said sleeve for both slidable movement through said sleeve and rotatable movement with said sleeve such that rotation of said sleeve determines the amount of gas flow through said sleeve.

12. The gas valve assembly of claim 11 further comprising a plurality of orifices of varying diameters in said gas metering sleeve such that rotation of said sleeve aligns one of said spaced orifices with said single valve outlet port thereby regulating the amount of gas flow coupled to said single valve outlet port.

13. A gas valve assembly for a pilotless gas burner system comprising:

a valve body;

a gas inlet port in said valve body;

a single gas outlet port in said valve body for providing gas to said gas burner;

a gas metering sleeve in said valve body between said gas input orifice and said gas outlet orifice and having an inner chamber terminating in first and second ends with a wall and a gas inlet orifice on one end and gas metering outlets;

a movable seal normally biased against said gas inlet orifice of said gas metering sleeve to prevent any gas flow to said single gas output port;

manually operated control means for forcing said seal away from said gas inlet orifice of said gas metering sleeve and for controlling said gas metering outlets to allow a predetermined amount of gas flow through said single gas outlet port sufficient for ignition of said burner and to adjust the gas flow through said single output port after ignition of said burner; and a tapered orifice forming the gas metering outlet on said sleeve opposite said gas inlet orifice through which tapered orifice said shaft slidably extends; and a gas control assembly mounted on said shaft for axial movement with said shaft within said tapered orifice such that rotation of said shaft causes axial movement of said shaft to progressively open and close said tapered orifice with said gas control assembly to allow more or less gas flow therethrough.

14. The gas valve assembly of claim 13 further comprising:

a cylindrical bore in said sleeve between said gas inlet orifice and said tapered orifice;

said first and second orifices in said sleeve coupling the sleeve chamber to said outlet port; and said first orifice being closed by said gas control assembly when said control shaft is forced inwardly to force said seal away from said sleeve gas inlet orifice and allow ignition gas to flow to said burner; and said first and second orifices in said sleeve being opened by said gas control assembly for minimum gas flow operation when said shaft is retracted sufficiently.

15. The gas valve assembly of claim 14 wherein said gas control assembly further comprises:

an O-ring assembly mounted on said control shaft for axial movement within said tapered orifice on said sleeve and within said circular bore to close one of said orifices in said circular bore in a first axial position to allow ignition gas flow;

said first and second orifices in said sleeve wall being opened in a second axial position of said control shaft to allow for said minimum or low gas flow operation; and the relative axial position of the O-ring assembly varying with respect to the tapered orifice in additional axial positions of said shaft to vary the gas flow said burner.

16. The gas valve assembly of claim 15 wherein the axial position of said O-ring assembly relative to said tapered orifice is varied by rotating said shaft.

* * * * *